US006874915B1

(12) United States Patent
Eisen

(10) Patent No.: US 6,874,915 B1
(45) Date of Patent: Apr. 5, 2005

(54) INFLATABLE READING LIGHT

(76) Inventor: Lawrence D. Eisen, 5013 Benton Ave., Bethesda, MD (US) 20814

( * ) Notice: Subject to any disclaimer, the term of this patent is extended or adjusted under 35 U.S.C. 154(b) by 0 days.

(21) Appl. No.: 10/253,868

(22) Filed: Sep. 25, 2002

(51) Int. Cl.[7] ..... F21V 1/06
(52) U.S. Cl. ..... 362/385; 362/320; 362/278; 362/418; 362/96
(58) Field of Search ..... 362/385, 320, 362/278, 432, 418, 96

(56) References Cited

U.S. PATENT DOCUMENTS 2,498,270 A * 2/1950 Hawley
3,835,308 A * 9/1974 Reese ..... 240/10 C
3,836,761 A * 9/1974 Kleinman et al. ..... 240/10 C
5,262,768 A * 11/1993 Florer ..... 340/815.15
5,295,891 A * 3/1994 Schalk ..... 446/222
5,444,607 A * 8/1995 Dreyfuss ..... 362/352
6,106,135 A * 8/2000 Zingale et al. ..... 362/186
6,146,001 A * 11/2000 Cwiakala ..... 362/267
6,322,230 B1 * 11/2001 Medici ..... 362/96
6,371,638 B1 * 4/2002 Zingale et al. ..... 362/565 S
6,428,185 B1 * 8/2002 Lin ..... 362/253
6,431,729 B1 * 8/2002 Chen ..... 362/249
6,523,778 B2 * 2/2003 Key et al. ..... 244/31

* cited by examiner

*Primary Examiner*—Sandra O'Shea
*Assistant Examiner*—Jacob Y. Choi

(57) ABSTRACT

An inflatable flexible illuminating apparatus includes an inflatable flexible member having a first end and a second end with the first end being secured to a base and the second end having a light emitting source fixed in proximity thereto. The inflatable flexible member has a non-extended, non-rigid configuration when in a non-inflated state and the inflatable flexible member has an extended configuration when in a substantially fully inflated state. The inflatable flexible member is sufficiently rigid to be self supporting in a predetermined shape when in the substantially fully inflated state. A power source is connected to the light emitting source and a pump or motorized fan is provided to inflate the inflatable flexible member.

18 Claims, 5 Drawing Sheets

INFLATABLE READING LIGHT

FIELD OF INVENTION

The present invention is directed to devices for lighting or illumination. More particularly, the present invention is directed to an inflatable, or partially inflatable member, upon which or to which an illuminating device is mounted, or through which light travels.

BACKGROUND OF THE INVENTION

The present invention was developed in view of the desire to have a lightweight and safe light or illuminating device that is used as a reading or night light and that can be used without worry in, e.g., a child's room. Presently, there are commercially available several different lights and fixtures that extend from a base that rests on a table or extend from a base that is mounted to a wall. However, these light fixtures are typically comprised of metal or hard plastic parts that can injure children who may inadvertently come into contact with the fixture when, for example, jumping on a bed or "wrestling" with friends or family members.

SUMMARY OF THE INVENTION

In view of the inherent dangers and concerns associated with prior art lighting or illuminating devices, the present invention provides an illuminating "fixture" that is flexible and easily deformable when inadvertently hit by a person. The flexibility of the illuminating device of the present invention is made possible by employing an inflatable member upon which or to which a light emitting source, such as a small bulb or light emitting diode (LED) is affixed. The flexible member (also referred to herein simply as a "tube") preferably takes on an inflated or a non-inflated state, as well as varying states of inflation in between, whereby even if someone were to inadvertently hit or come into contact with the tube, the tube would bend or deform thereby avoiding any bodily injury to that person.

The bulb or LED is preferably attached to one end of the tube while the other end of the tube is fixed to a base unit that is either affixed to a wall or rests on a flat surface such as a table. In one embodiment of the invention, the tube, when in a non-inflated state, is stored in a combination base and storage box.

In yet another embodiment of the invention, the tube preferably has a reflective internal skin and the light emitting source is disposed substantially near the end of the tube that is affixed to the base. The opposite end of the tube includes an opening through which the light is dispersed.

DETAILED DESCRIPTION OF THE PREFERRED EMBODIMENTS

Figure 1:
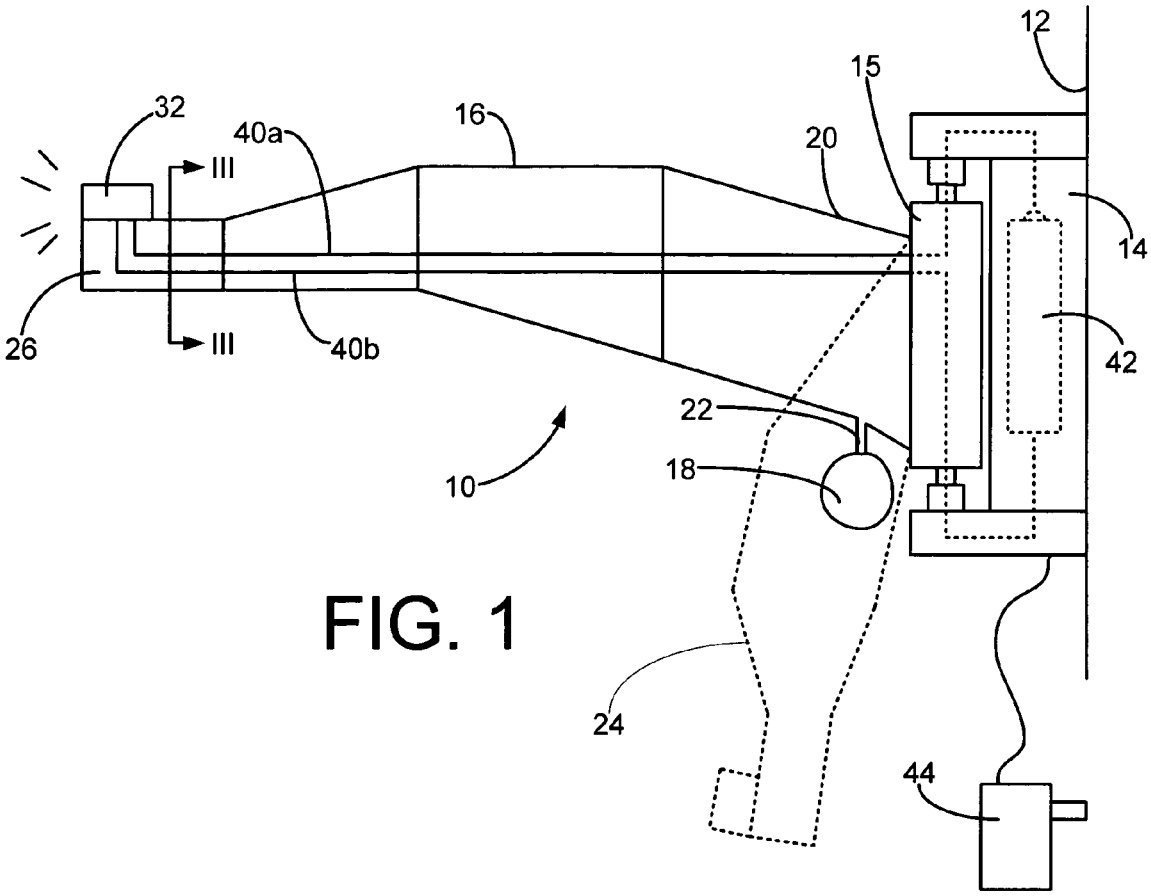
FIG. 1 shows an illuminating apparatus in accordance with the present invention.

An illuminating apparatus 10 according to one embodiment of the present invention is illustrated in FIG. 1. In this particular embodiment, the illuminating apparatus 10 is mounted on a wall 12 so that it can be used, for example, as a reading light in a bedroom. Apparatus 10 includes a base unit 14 that, in this embodiment, is preferably securedly fixed to wall 12 by well-known methods, such as by one or more screws (not shown). Apparatus 10 also includes an inflatable flexible member 16. Member 16 is referred to hereinafter as "tube" 16, but those skilled in the art will appreciate that tube 16 can actually take on one or a combination of several different shapes, as will be explained below.

Tube 16 is preferably made of rubber or plastic of the type that can be relatively easily inflated using a simple bulb pump or dome pump (the latter being shown with respect to other embodiments) having disposed therein a one way valve. Well-known vinyl or mylar are but two possible types of material that can be employed for tube 16. FIG. 1 shows a hand held bulb pump 18 (like those commonly used with, for example, conventional blood pressure cuffs), which is in communication with a first end 20 of tube 16 either directly, or as shown in FIG. 1, via a connection tube 22. First end 20 is attached to base unit 14 such that tube 16 itself is also secured to wall 12. Connection can be by adhesive, by sandwiching the material of tube 16 between portions of base unit 14, or by any other known means of attaching a member like flexible tube 16 to a rigid body. Tube 16 may be integrally formed with at least a portion of base unit 14. Base unit 14 is preferably comprised of molded plastic, but could also be comprised of metal, ceramic or other solid material.

As shown in FIG. 1, tube 16 can be in a non-inflated state (shown by broken line 24) or can be in an inflated state, as shown by the unbroken line of tube 16 (or, of course, stages of inflation in between fully deflated and fully inflated). More specifically, tube 16 has a non-extended, non-rigid configuration when in a non-inflated state and tube 16 has an extended, substantially rigid configuration when in an inflated state. Also, when tube 16 is in a substantially, or fully, inflated state it is sufficiently rigid to be self supporting in a predetermined shape such as, in the case of FIG. 1, a substantially straight, slightly curved, curved, and/or segmented tube shape. Tube 16 is preferably deflated via, e.g, another one way valve or pin valve associated with tube 16. Such mechanisms are well-known in the art.

Figure 2A:
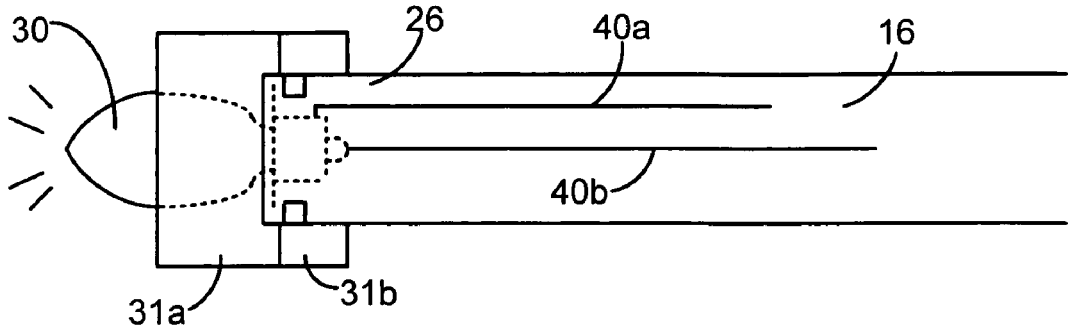
FIGS. 2A–C show exemplary configurations of the second end of the flexible inflatable tube in accordance with the present invention.

At the opposite end of first end 20 is a second end 26. Second end 26 is illustrated in more detail in FIGS. 2A, 2B and 2C. As shown in those Figures, second end 26 preferably comprises a light emitting source. In the embodiments depicted in FIGS. 2A–C, the light emitting source is a relatively small, lightweight bulb 30, such as a conventional flashlight bulb. FIG. 2A shows bulb 30 disposed at a distal end of second end 26 and secured to distal end 26 via cuff 31*b* and cap 31*a*, which can together act to sandwich a flange of flashlight bulb 30 between the complementary parts 31*a*, 31*b*.

Figure 2B:
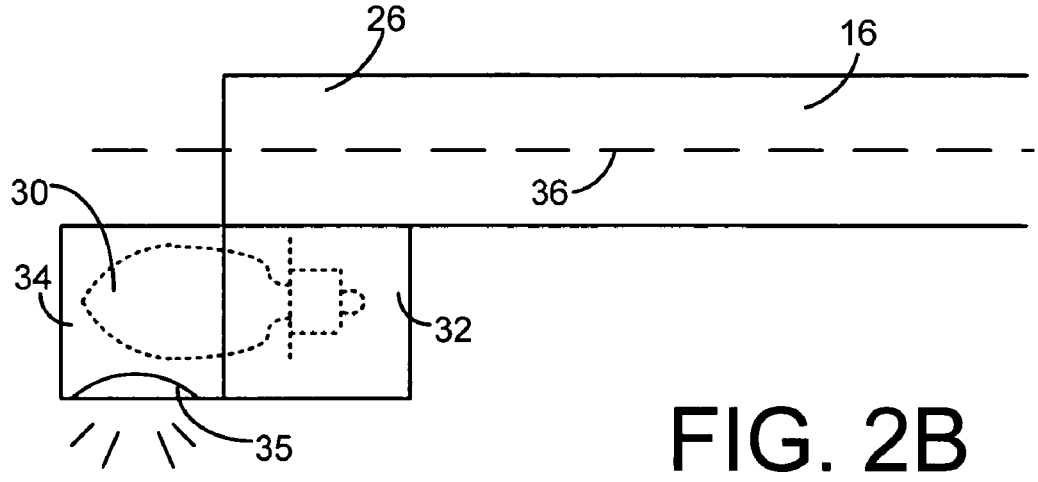
Figure 2C:
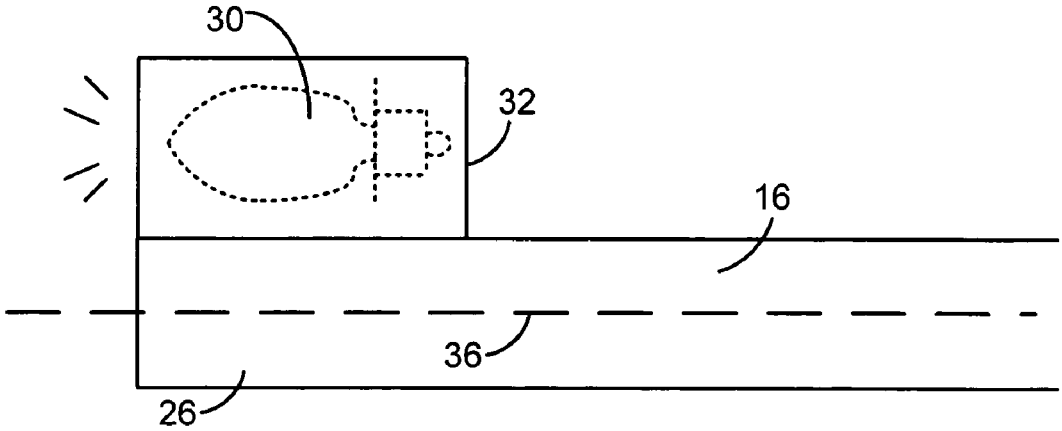

FIGS. 2B and 2C illustrate how bulb 30 can be disposed within a tubular shade 32 (or any other desired shade shape). FIG. 2B shows a shade 32 with a rotatable portion 34 that directs light through opening 35 substantially perpendicular to a longitudinal axis 36 of tube 16. FIG. 2C shows bulb 30 disposed within shade 32 such that light is directed substantially parallel to longitudinal axis 36. Where desired, shade 32 may also comprise a lens (not shown), which may be adjustable, to focus light at a desired point. Such lens structures are well-known in the art and are used, for example, on flashlights that are commercially available. It is noted that it is well-known in the art to provide a socket for bulb 30 that is either integral with shade 32 or that can be incorporated into such a shade.

Although bulb 30 is depicted as the light emitting source, other light sources can also be used in conjunction with the present invention. For example, one or more light emitting diodes (LEDs) can be employed in place of bulb 30. Such LEDs are relatively inexpensive, take up less volume and are lighter (in weight) than a flashlight light bulb. LEDs may also consume less power, thereby making the apparatus 10 more energy efficient, which could be important if the light emitting source is being powered by a battery or batteries.

To provide power to the second end 26 and to the light emitting source, a pair of electrical conductors 40*a*, 40*b* are disposed along an inside (not shown) or outside (shown) surface of tube 16. These electrical conductors 40*a*, 40*b* are preferably comprised of lightweight, flexible material such as magnet wire, conductive tape, or other conductive threads that preferably have little or substantially no effect on the form that tube 16 exhibits when in the inflated or deflated states.

Electrical conductors 40*a*, 40*b* preferably transmit electrical power from batteries 42 that are disposed in base unit 14, or from an AC adapter 44 that can be plugged into a conventional wall socket (FIG. 1).

Because tube 16 is flexible and electrical conductors 40*a*, 40*b* have physical properties (e.g., spring coefficient, torsional resistance) that preferably are insignificant with respect to the mass and material of tube 16, tube 16 is for all intents and purposes as flexible as it would be without the electrical conductors. Accordingly, even in the inflated state, tube 16, while sufficiently rigid to maintain a predetermined shape, is also sufficiently flexible to bend or be deformed when bumped into by a person who may accidentally come into contact with tube 16. Thus, even though tube 16 might extend several inches or even feet from wall 12, it preferably bends or deforms when bumped, ensuring safety for, e.g., children that may be playing in the vicinity of the apparatus 10.

Figure 3:
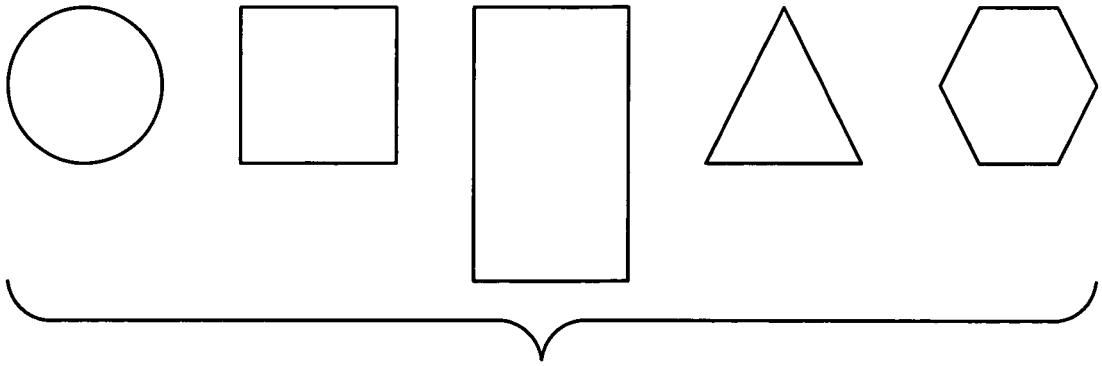
FIG. 3 shows several exemplary cross sectional shapes for the flexible inflatable tube in accordance with the present invention.

As shown in FIG. 3, the cross sectional shape of "tube" 16 can preferably be one of any number of shapes depending on the type of aesthetics desired, or tube strength required.

Although base unit 14 is shown only with a hinge 15 (FIG. 1), base unit 14 can also be equipped with, e.g., a ball and socket joint (not shown) that is adjustable such that tube 16 can be adjustably pointed in substantially any desired direction. Thus, when in a deflated state, tube 16 rests against wall 12, but when inflated, tube 16 will, since it is sufficiently rigid to maintain a predetermined shape, extend to a preselected position, e.g., one which is comfortable for reading.

Figure 4:
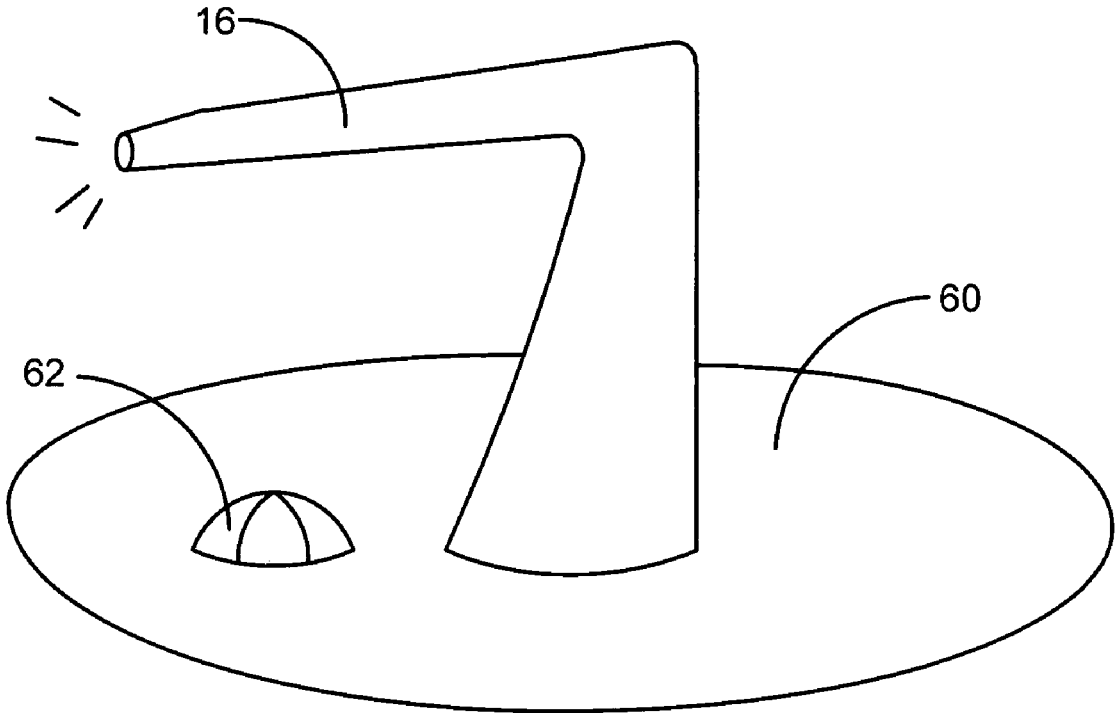
FIG. 4 shows another embodiment of the present invention.

FIG. 4 depicts another embodiment of the present invention in which a base 60, instead of being fixed to a wall, rests on a horizontal surface such as a table or night stand. In this embodiment there is no need to drill holes in a wall. Preferably, base 60 is sufficiently heavy to keep tube 16 from moving unexpectedly or unpredictably.

Also shown in FIG. 4 is hand pump 62 that has, for example, a hemispherical shape and is made of an elastic material (e.g., rubber) that can be deformed by a user's hand or fingers. Of course, hand pump 62 may be used instead of pump 18, as desired.

Figure 5:
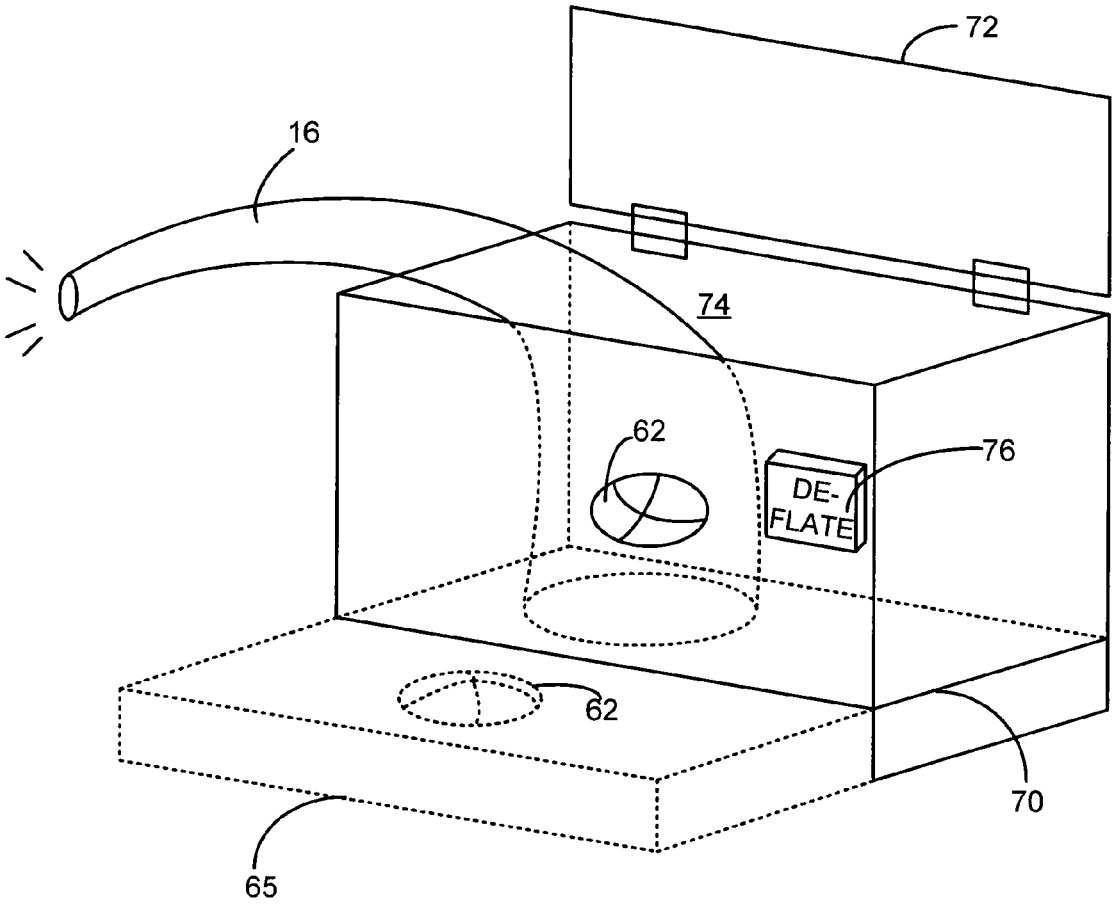
FIG. 5 shows still another embodiment of the present invention.

In still another embodiment of the present invention, illustrated in FIG. 5, there is provided a combination storage box and base 70. If desired, storage box 70 includes a top cover 72, which covers internal space 74 that is defined by the sides and bottom of storage box 70. Those skilled in the art will appreciate that storage "box" 70 need not necessarily exhibit a square or rectangular shape, but could be any one of a number of geometric shapes including polygons and circles. No matter the shape of storage box 70, it preferably has sufficient internal space 74 to store the entirety of tube 16 in its deflated state such that the illuminating apparatus 10 is contained substantially entirely or entirely within storage box 70 when not in use. In a preferred aspect of the invention, hand pump 62 is integrated on an exterior surface of storage box 70, such as on a front surface thereof or on an extended bottom portion 65 (shown with dotted lines) as shown in FIG. 5. The former configuration is preferable when wall mounting storage box 70, while the latter configuration is more desirable when storage box 70 is intended to be located on a table.

FIG. 5 also depicts a "deflate" button 76, which may operate a one way valve or control a pin valve, as mentioned above, that is in communication with tube 16.

In an alternative implementation of the invention, hand pump 18 or 62 can be replaced by an electrical switch that controls power to an electric fan that operates to inflate tube 16. In this alternative aspect, base 14, base 60 or combination storage box 70 preferably also includes a compartment in which to dispose a small electric motor and fan.

Preferably, the diameter of tube 16 is on the order of 0.5 to 3 inches, and will depend to some degree on aesthetics as well as the overall length of a fully inflated tube. Also, tube 16 need not be the same diameter for its entire length. Further, tube 16 can take on virtually any shape including spiral shapes and multi-segmented lengths.

In yet another embodiment of the present invention, a light source is disposed near and internal to first end 20 of tube 16 whereas second end 26 of tube 16 is provided with an opening. Light emitted by the light source shines through the opening and is directed as desired by the user. In this embodiment it is preferable that tube 16 comprises a non-translucent reflective skin on an internal surface thereof whereby substantially all of the light emitted from the light source is reflected through the opening.

The foregoing disclosure of the preferred embodiments of the present invention has been presented for purposes of illustration and description. It is not intended to be exhaustive or to limit the invention to the precise forms disclosed. Many variations and modifications of the embodiments described herein will be apparent to one of ordinary skill in the art in light of the above disclosure. The scope of the invention is to be defined only by the claims appended hereto, and by their equivalents.

What is claimed is:

1. An illuminating apparatus, comprising:

an inflatable flexible member, said member having a first end and a second end, said first end being secured to a base and said second end having a light emitting source fixed in proximity thereto;

said inflatable flexible member having a non-extended, non-rigid configuration when in a non-inflated state and said inflatable flexible member having an extended configuration when in a substantially fully inflated state, said inflatable flexible member being sufficiently rigid to be self supporting in a predetermined shape when in said substantially fully inflated state;

a power source connected to said light emitting source; and means for inflating said inflatable flexible member, wherein the base comprises a hinge to orient said inflatable flexible member, when in an inflated state, in a desired direction with respect to the base.

2. The illuminating apparatus of claim 1, wherein the base is configured to be secured to a wall.

3. The illuminating apparatus of claim 1, wherein the base is configured to be lain on a horizontal surface.

4. The illuminating apparatus of claim 1, further comprising electrical conductors that run along a surface of the inflatable member.

5. The illuminating apparatus of claim 1, wherein the light emitting source comprises a light bulb.

6. The illuminating apparatus of claim 1, wherein the light emitting source comprises a light emitting diode.

7. The illuminating apparatus of claim 1, wherein the base is comprised of a storage box for storing the inflatable flexible member.

8. An illuminating apparatus, comprising:

an inflatable flexible member, said member having a first end and a second end, said first end being secured to a base and said second end having a light emitting source fixed in proximity thereto;

said inflatable flexible member having a non-extended, non-rigid configuration when in a non-inflated state and said inflatable flexible member having an extended configuration when in a substantially fully inflated state, said inflatable flexible member being sufficiently rigid to be self supporting in a predetermined shape when in said substantially fully inflated state; and said base comprising (i) means for storing said inflatable flexible member when in said non-inflated state and (ii) means for inflating said inflatable flexible member, wherein at least a portion of the inflatable flexible member is located within said means for storing when the inflatable flexible member is substantially fully inflated, and wherein the means for inflating (i) is integral with said means for storing, (ii) extends away from said base, and (iii) is accessible from outside said means for storing for manual manipulation.

9. The illuminating apparatus of claim 8, wherein the means for storing comprises a storage box.

10. The illuminating apparatus of claim 8, wherein the means for storing is configured to be secured to a wall.

11. The illuminating apparatus of claim 8, wherein the means for storing is configured to be lain on a horizontal surface.

12. The illuminating apparatus of claim 8, wherein the means for inflating is located on a vertical surface of the means for storing.

13. The illuminating apparatus of claim 8, wherein the means for inflating is located on a horizontal surface of the means for storing.

14. The illuminating apparatus of claim 8, wherein the base comprises means for positioning the inflatable member.

15. The illuminating apparatus of claim 8, wherein the light emitting source comprises a light bulb.

16. The illuminating apparatus of claim 8, wherein the light emitting source comprises a light emitting diode.

17. An illuminating apparatus, comprising:

an inflatable flexible member;

a light emitting source disposed at one end of the inflatable flexible member;

a shade substantially surrounding the light emitting source, the shade comprising a rotatable portion having an opening through which light from the light emitting source passes;

a base to which another end of the inflatable flexible member is fixed, the base including a hinge to orient said inflatable flexible member, when in an inflated state, in a desired direction with respect to the base;

a power source electrically connected to the light emitting source; and a pump in communication with the inflatable flexible member and operable to inflate the inflatable flexible member.

18. The illuminating apparatus of claim 17, wherein the base comprises a storage box.

* * * * *